United States Patent [19]

Voisin et al.

[11] 4,152,156

[45] May 1, 1979

[54] DUPLICATION-PROOF PHOTOGRAPHIC FILM

[75] Inventors: Paul-Henri Voisin, San Mateo; Michael F. Mizianty, Sunnyvale, both of Calif.

[73] Assignee: Xidex Corporation, Sunnyvale, Calif.

[21] Appl. No.: 514,354

[22] Filed: Oct. 15, 1974

[51] Int. Cl.[2] ..... G03C 1/58; G03C 1/52

[52] U.S. Cl. ..... 96/49; 96/75

[58] Field of Search ..... 96/75, 49

[56] References Cited

U.S. PATENT DOCUMENTS

| | | | |
|---|---|---|---|
| 2,699,392 | 1/1955 | Herrick et al. | 96/75 |
| 3,260,599 | 7/1966 | Lokken | 96/75 |
| 3,408,192 | 10/1968 | Aebi | 96/49 |
| 3,411,906 | 11/1968 | Boone et al. | 96/49 |
| 3,622,333 | 11/1971 | Cope | 96/75 |
| 3,661,591 | 5/1972 | Reed | 96/75 |
| 3,904,420 | 9/1975 | Hunter | 96/75 |

FOREIGN PATENT DOCUMENTS

| | | | |
|---|---|---|---|
| 645825 | 11/1950 | United Kingdom | 96/49 |

*Primary Examiner*—Travis Brown
*Assistant Examiner*—Louis Falasco
*Attorney, Agent, or Firm*—Townsend and Townsend

[57] ABSTRACT

Photographic element designed to prevent duplication by contact copying with actinic light, formed from a synthetic organic polymer having a nitrogen gas permeability suitable for use as a vehicle in a vesicular film, and a light sensitive diazotype composition dispersed therein in which the diazotype composition includes a light decomposable diazonium salt and a coupler for forming a dye with said diazonium salt. Upon imagewise exposure and development, the light-struck areas are vesiculated and an azo dye is formed in the nonlight-struck areas. The image formed from the vesicules relative to the azo dye provide sufficient contrast for viewing by projected light but insufficient contrast for contact copying with UV light.

2 Claims, No Drawings

DUPLICATION-PROOF PHOTOGRAPHIC FILM

BACKGROUND OF THE INVENTION

1. Field of the Invention

This invention relates to photography. More particularly, it relates to photographic film containing diazo materials designed to prevent duplication of images therein by contact copying with actinic light.

Micropublishing uses microforms (films, fiche, etc.) for distribution of published material. These films often contain original works unavailable in other media. While these films offer many advantages over conventional printed paper, they suffer from ease of duplication. Unauthorized copies can readily be made which would deprive the micropublisher and author from exclusive rights to such material. These copies can be made on inexpensive contact duplication equipment by relatively unskilled personnel. This invention would prevent such unauthorized duplication.

The above-noted contact duplication process requires an appreciable difference in actinic light absorption between imaged and non-imaged areas on the film. The actinic light of most importance for duplication is the near ultra-violet and blue regions of the spectrum. Thus, a measure of the difference of ultraviolet light opacity between imaged and non-imaged areas is a good indication of the ease of duplication. To prevent copying this opacity difference should approach zero. This state is difficult to obtain since most images contain an appreciable amount of ultraviolet opacity.

2. Description of the Prior Art

Several methods have previously been proposed to equalize the ultraviolet light opacity between imaged and non-imaged areas. In one, an ultraviolet light absorber or yellow dye is incorporated in the light sensitive layer of the film. This method reduces the photographic sensitivity with the result being an extremely slow film. The UV absorber may be placed in the filmbase, however, this would require a special and more expensive base. The use of multilayered coatings is another method. These coatings may contain a UV absorber or may be a surface laminate designed to blur the image on copying. Multilayer coatings are a manufacturing disadvantage since they involve higher cost and increased opportunity for film defects. The present invention is superior to these prior methods in that a single layer coating of high photographic speed on ordinary filmbase is used to produce a duplication proof film.

SUMMARY OF THE INVENTION

In accordance with the present invention, a photographic element is provided which in use results in a difference of UV light opacity between imaged and non-imaged areas which is sufficiently low to prohibit duplication by contact copying with actinic light. In a broad sense, the photographic element is made from a synthetic organic polymer of the type conventionally used as a vehicle in vesicular film and thus has a nitrogen gas permeability of the character required for vesicular film. Dispersed throughout this vesicular vehicle is a conventional light sensitive diazotype composition which generally includes a light decomposable diazonium salt and a coupler for forming a dye with said diazonium salt. The present element may be viewed as a conventional vesicular film vehicle containing a conventional light sensitive diazotype composition instead of the sensitizer used in vesicular film. Conversely, the vesicular film vehicle is substituted for the vehicle conventionally used in diazotype reproduction media. However, since vesiculation in the imaged areas is desired, additives used in vesicular film sensitizer formulations may be included and treatments may be applied of the type used with vesicular film.

By way of explanation of the observed phenomena of this invention, the light sensitive agent used is a diazonium salt which on exposure to actinic light produces nitrogen gas. This gas is used to produce a vesicule by expansion in the polymeric vehicle. The vesicules are formed in the light-struck areas of the film. In the absence of light the diazonium salt remains stable and is capable of reacting with a coupler to form an actinic light absorbing azo dye. In the preferred embodiment, the vesicule and azo dye formation may be executed in one development step by the application of pressurized ammonia gas. Suitable equipment for such development is available commercially for processing conventional diazo film.

The resulting film is easily viewable giving a dense black image typically on a pale yellow background. The black image results from the scattering of projected light by the vesicules. The light scattering effect of the vesicules is much greater than the visible light absorption by the azo dye. This difference is shown by measuring the projection density of the image. A density difference ($\Delta$) of 2 is easily obtained.

While projection density is an important property for determining utility in observing an image in a viewer, it is not a good measure of opacity for the contact method of copying. To determine ease of copying the diffuse density in the actinic region must be used. For the film described in this invention this diffuse density is essentially equal for the imaged and non-imaged areas. This equality in diffuse actinic density results from two effects. First, the light scattering ability of the vesicule is a function of distance which results in the diffuse Dmax. being lower than its projection Dmax. The second effect is the actinic diffuse density of the azo dye is much larger than its projection density. The dyes formed in these films are preferably selected from maximum absorption in the actinic region with little absorption of visible light.

The terminology "diffuse density" and "projection density" are used herein in the commonly accepted manner. With conventional photographic material (silver, diazo . . . etc.) a diffuse density measures the non-absorbed or transmitted light going through a homogeneous image. In the vesicular system the phenomenon of absorption is complicated by the fact that light is absorbed, refracted and reflected by the bubble image. In this case the diffuse density will also measure the effective amount of light going through the vesicular image but will not give a good representation of the opacity or darkness of the image observed in a viewer or projector. The specular or projection density is then introduced; the film sample is illuminated this time by a collimated light where projection lens gather the transmitted light over a solid angle corresponding to a relative aperture.

The actinic diffuse density mentioned in the above description qualifies only the ultraviolet part of the light susceptible of decomposing the diazo salt.

DETAILED DESCRIPTION OF THE INVENTION

The following examples will illustrate the invention:

EXAMPLE I

A coating solution is prepared in the following manner:

Condensation polymer of resorcinol, bis(p-hydroxyphenyl)sulfone and epichlorohydrin, as described in U.S. Pat. No. 3,622,333—5.00 grams 2,5-diethoxy-4-morpholinobenzenediazonium fluoborate—0.15 grams N,N'-ethylene-bis-acetoacetamide—0.10 grams 5-sulfosalicylic acid—0.08 grams 2-methoxyethanol—20.00 grams The solution is coated on a poly(ethylene terephthalate) support and dried to yield a 6 micron thick coating. The coating is exposed through a silver step wedge to a medium pressure mercury arc lamp (400 watt) and developed by a five second application of 30 psig of anhydrous ammonia at 60° C.

The following densities resulted:

| Density | Projection (f4.5) | Diffuse (Kodak 18A filter) |
|---|---|---|
| Dmax. | 2.35 | 1.01 |
| Dmin. | .12 | 1.06 |

Attempts to copy this film by contact printing on vesicular or diazo duplication films failed to yield a discernable image.

EXAMPLE II

Mix to dissolve:

| | |
|---|---|
| Eponol 55[1] BQ20 (solution 20%) | 25 grams |
| 2,5-diethoxy-4-morpholinobenzenediazonium fluoborate | 0.20 grams |
| 5-sulfosalicylic acid | 0.10 grams |
| N,N'-ethylene-bis-acetoacetamide | 0.20 grams |

[1]Shell Trade Name: polymer produced by condensation of bis-phenol A and epichlorohydrin at 20% solids in methyl ethyl Ketone.

This solution is coated on polyester "Mylar" base using an applicator blade to give a coating of about 15 microns thick after a drying period of 5 minutes in a forced air over at 105° C.

A sample of this film is then immersed in a water bath for 30 seconds at 80° C.

This film is first exposed for 30 seconds through a step wedge Kodak No. 2 to a medium Hg arc lamp (400 watts) at a distance of 6 inches and immediately developed under 80 psig ammonia pressure at 82° C. for 5 seconds. The image of 6 steps appears: this is the vesiculated part of the film. In the non-vesiculated part of the film (Dmin) a yellow-orange color is developed.

To demonstrate the difficulty of making copy from this film, a contact copy on Kalvar Mikrolith 200 is done using a two-minute exposure time; the Kalvar film is developed by heating for 2 seconds at 130° C. and an overall foggy image appears.

The projection densities of the imaged duplication-proof film are measured:

| STEP No. | 1 (Dmax) | 2 | 3 | 4 | 5 | 6 | (Dmin) |
|---|---|---|---|---|---|---|---|
| DENSITY | 2.50 | 2.40 | 1.90 | .75 | .40 | .15 | .14 |

The projection densities of the duplicated image of the 6 steps on Kalvar film are measured:

| STEP No. | 1 (Dmax) | 2 | 3 | 4 | 5 | 6 | (Dmin) |
|---|---|---|---|---|---|---|---|
| DENSITY | 1.20 | .75 | .50 | .90 | .85 | 1.20 | 1.20 |

No sufficient difference in density between Dmax and Dmin is obtained to give a discernable image.

EXAMPLE III

A 16 weight percent epoxy solution was prepared by diluting 20 g of Shell Eponol 55 BQ20 (a 20% epoxy solution in methyl ethyl ketone) with 5 g of 2-methoxyethanol; to this stirred solution was added:

4-benzamido-2,5-diethoxybenzenediazonium chlorozincate—0.16 grams acetoacetanilide—0.12 grams 5-sulfosalicyclic acid—0.12 grams After dissolution, the coating mix was coated on poly(ethyleneterephthalate) film base using an applicator blade to give an 11 micron thick coating, and dried for five minutes in a forced air over at 105° C.

A sample of this film was then immersed in a water bath for 30 seconds at 85° C.

A sample was then exposed through a silver step wedge to a medium pressure mercury arc lamp (400 watts) for 60 seconds and developed by a five-second application of 80 psig of anhydrous ammonia at 100° C.

Image of the step wedge appeared and the following densities were measured:

| OPTICAL DENSITY | PROJECTION (f4.5) | DIFFUSE (18A filter) |
|---|---|---|
| Dmax | 2.37 | .98 |
| Dmin | .11 | .92 |

Again here, no sufficient difference in diffuse densities between Dmax and Dmin is obtained to give discernable image in the duplication step.

EXAMPLE IV

The procedure of Example II was followed except that the polymer solution Eponol BQ20 was changed for a 20 percent solution in methylethylketone of a mixture of Saran F-120 (vinylidenechlorideacrylonitrile copolymer) and Acryloid 11 poly (methylmethacrylate) in the ratio 3 to 1 by weight.

The densities were measured:

| OPTICAL DENSITY | PROJECTION (f4.5) | DIFFUSE (18A filter) Kodak |
|---|---|---|
| Dmax | 2.50 | 1.28 |
| Dmin | 0.12 | 1.28 |

In general, the vehicle suitable for use in the present invention is one that is suitable for use as a vesicular vehicle in the making of a vesicular film as well known in the art. Preferably, the vehicle is a water-resistent synthetic organic polymer having appropriate nitrogen gas permeability for a vesicular film. Typical of such synthetic organic polymers are the thermoplastic linear poly(hydroxy ethers) formed from the condensation of poly hydroxy phenol and an epihalohydrin as described in U.S. Pat. No. 3,622,333, which materials are preferred. However, any other vesicular vehicle known in the art may be utilized, such as the synthetic organic polymers described in U.S. Pat. No. 3,032,414 and those described in patent application, Ser. No. 72,913, filed Sept. 17, 1970.

In general, the vesicular film vehicle contains dispersed therein a conventional light sensitive diazotype composition. Typically, such a composition contains a light decomposable diazonium salt and a coupler for forming an azo dye. Preferably, the coupler is selected to form a dye of relatively high UV opacity and low visible density. Typical diazotype formulations are disclosed in U.S. Pat. Nos. 3,679,413 and 3,427,162. As described in the prior art, the diazotype compositions may include a single diazonium salt and a single coupler. Alternatively, combinations of light sensitive salts and combinations of couplers may be included. Other additives such as stabilizers may also be included. All of these diazotype formulation variations are contemplated for use in the present invention.

As noted, the present film contemplates vesiculation in the light-struck areas. Accordingly, additives used in vesicular sensitizer formulations may be included such as those described in U.S. Pat. Nos. 3,779,768 and 3,779,774. Also, the film may be given special treatments employed with vesicular film such as those described in U.S. Pat. No. 3,149,971 and that described in U.S. Pat. No. 3,841,874.

As shown in the above examples of the preferred embodiments, the photographic element of this invention is utilized by subjecting it to image-wise exposure under suitable conditions to vesiculate the light-struck areas and form an azo dye in the nonlight-struck areas. In the preferred embodiments, development is executed by subjecting the exposed element to a suitable amount of heat and/or pressure. Preferred conditions for development include contacting the exposed element with anhydrous ammonia at a pressure of about 1-10 atmospheres and a temperature of about 20°-150° C. The use of pressurized anhydrous ammonia for the development of diazotype materials is described in U.S. Pat. No. 3,427,162.

What is claimed is:

1. A method for producing an image-wise exposed photographic element designed to prevent duplication by contact copying with actinic light comprising: providing a photographic element having a base support and coated thereon a layer of a synthetic organic polymer of the type suitable for use as a vehicle in vesicular film, and a light sensitive diazotype composition dispersed in said polymer including a light decomposable diazonium salt and a coupler for forming a dye with said diazonium salt of a relatively high UV opacity and low visible density; subjecting said photographic element to image-wise exposure; and developing said exposed element with sufficient heat and pressure in an alkaline environment to vesiculate the light-struck areas in said polymer and form an azo dye in the nonlight-struck area thereof, the diffuse actinic densities of said vesiculated and azo dye containing areas being substantially equal.

2. A method in accordance with claim 1, wherein said exposed element is developed by contact with anhydrous ammonia at a pressure of about 1-10 atmospheres and a temperature of about 20°-150° C.

* * * * *